United States Patent [19]

Beaulieu et al.

[11] 3,954,520

[45] May 4, 1976

[54] PROCESS FOR THE PRODUCTION OF MAGNETIC MATERIALS

[75] Inventors: Thomas J. Beaulieu, San Jose, Calif.; Michael A. Marchese, Boulder; Franklin T. Plante, Longmont, both of Colo.; Robert H. Tlaskal, De Funiak Springs, Fla.

[73] Assignee: International Business Machines Corporation, Armonk, N.Y.

[22] Filed: Mar. 11, 1974

[21] Appl. No.: 449,861

[52] U.S. Cl. ..... 148/105; 75/.5 AA; 148/108; 427/128

[51] Int. Cl.[2] ..... H01F 1/02

[58] Field of Search..... 148/105, 108; 75/.5 AA, 75/.5 R; 324/117 R; 427/127, 128

[56] References Cited

UNITED STATES PATENTS

| | | | |
|---|---|---|---|
| 2,884,319 | 4/1959 | Fabian et al. | 75/.5 AA |
| 3,026,215 | 3/1962 | Fukuda et al. | 148/108 |
| 3,494,760 | 2/1970 | Glnder | 75/.5 AA |
| 3,567,525 | 3/1971 | Graham et al. | 148/105 |
| 3,607,218 | 9/1971 | Akashi et al. | 75/.5 AA |
| 3,661,556 | 5/1972 | Jolley et al. | 75/.5 AA |
| 3,669,643 | 6/1972 | Bagley et al. | 148/105 |
| 3,684,484 | 8/1972 | Marchese et al. | 75/0.5 A |
| 3,726,664 | 4/1973 | Parker et al. | 75/.5 AA |
| 3,756,866 | 9/1973 | Parker et al. | 148/105 |

OTHER PUBLICATIONS

Judge, J. et al.; Prep'n. of High Coerc. Particles, in IBM Tech. Bul., 9, (3) Aug. 1966 p. 320.

Bozorth, R; Ferromagnetism, New York, 1951 pp. 3–5 and 14–15.

*Primary Examiner*—Walter R. Satterfield

*Attorney, Agent, or Firm*—Donald W. Margolis

[57] ABSTRACT

The problem of characterizing metallic magnetic particles as suitable or unsuitable for use in a high density magnetic recording media is believed to have been solved by use of a figure of merit designated as "$W/H_c$", and defined herein.

It has been found that metallic magnetic particles which exhibit a $W/H_c$ of about 1.2 or less offer the most desirable magnetic recording characteristics for high density magnetic recording media. With this characterization technique available, it has been determined that most quantities of metallic magnetic cobalt-phosphorus particles produced by chemical reduction have $W/H_c$'s greater than 1.2, and are unsuitable for use in high density magnetic recording media. Using $W/H_c$, it has been possible to recognize those metallic particles which are suitable for use in high density recording media, and to engage in experimentation to determine what methods of manufacturing are required for the production of suitable high density recording particles.

Surprisingly, following the recognition of the problem, it has been found that production of cobalt-phosphorus particles by controlled chemical reduction in a D.C. magnetic field of at least about 200 gauss consistently produces magnetic particles having $W/H_c$ of about 1.2 or less. In the absence of a D.C. magnetic field of at least about 200 gauss, cobalt-phosphorus particles having a $W/H_c$ as low as 1.2 are rarely produced.

11 Claims, 2 Drawing Figures

PROCESS FOR THE PRODUCTION OF MAGNETIC MATERIALS

CROSS REFERENCES TO RELATED APPLICATIONS

The following application is assigned to the assignee of the present invention: U.S. patent application Ser. No. 449,862, filed Mar. 11, 1974, entitled "Process for the Production of Magnetic Material Having Selective Coercivity", showing D. R. Craig et al. as inventors, and filed simultaneously with this application.

BACKGROUND OF THE INVENTION

1. Field of the Invention

This invention relates to methods of making metallic magnetic cobalt-phosphorus alloy particles by controlled chemical reduction under the influence of a D.C. magnetic field, and to the use of such particles in magnetic recording media and magnetic recording systems. It does not relate to the treatment of magnetic particles in a magnetic field after the particles have come into existence.

2. Description of the Prior Art

Both the production of cobalt-phosphorus particles by chemical reduction and the use of a magnetic field during the production of magnetic particles and magnetic films are known in the prior art. However, the problem of defining cobalt-phosphorus magnetic particles produced by chemical reduction which are suitable for high density recording in terms of the figure of merit herein designated as $W/H_c$, the importance and interpretation of $W/H_c$ and the effect of a specific type (D.C.), and magnitude (at least about 200 gauss) of magnetic field on the $W/H_c$ of cobalt-phosphorus particles during their production have not previously been appreciated. For example, prior art teachings of the use of a magnetic field during the production of magnetic material have often indicated that the use of either an A.C. or a D.C. magnetic field was interchangeable, have designated neither A.C. nor D.C., or have failed to designate the required minimum magnitude of the field.

It has long been theorized that metallic magnetic materials have characteristics which should make them more suitable for use in magnetic recording media than lower specific moment materials, such as iron oxide, for example. However, there is currently no large volume or general purpose recording media which is based upon the use of particulate magnetic metal.

Historically, the very first magnetic recording media developed were in the form of continuous metallic magnetic wires or bands. Initially, the use of solid magnetic metal recording media was quite satisfactory. Magnetic metals exhibited good properties of saturation magnetization and were easy to manufacture. However, they eventually fell out of favor due to their physical characteristics. For example, magnetic wire under tension tended to twist during both recording and playback, and as a result exhibited non-uniform signal output. Additionally, metallic magnetic wires and bands were bulky to store, heavy, and possessed relatively high inertia. This latter characteristic limited their utility in high speed stop/start/reverse and high density recording systems.

Subsequently, metallic magnetic wires and bands were replaced, primarily by light weight media formed of particulate magnetic material in a polymeric binder coated onto a substrate, usually in the form of a flexible tape. Such particulate magnetic tape had the advantage of being lower in bulk, weight, and inertia than solid metallic magnetic media. Additionally, the use of a tape structure, as opposed to wire avoided any tendency for the media to twist. Where magnetic iron oxide was the magnetic particle of choice, the media exhibited recording characteristics substantially as good as the solid magnetic metallic media it replaced, with the exception of saturation magnetization. High saturation magnetization is desirable, as it allows the recording and playback of a large or strong signal, and is thus especially desirable for high density recording.

Attempts were made to improve the saturation magnetization of low bulk, low weight, flexible media by utilizing thin magnetic metallic films deposited on a substrate by various coating techniques. However, such "plated" tapes tended to be susceptible to corrosion and wear to an extent that made them impractical, especially for high speed, high density recording system use.

Some efforts to provide a superior high density magnetic recording media attempted to substitute metallic magnetic particles for magnetic iron oxide. It was assumed, quite reasonably, that metallic magnetic particles having magnetic and physical characteristics equal to or better than iron oxide would provide particulate magnetic recording media superior to media based upon magnetic iron oxide. Despite the theoretical utility of metallic magnetic particles, they did not normally provide a signal superior to the signal from comparable iron oxide media, at the same volume or weight loadings as the iron oxide particles. Additionally, heretofore, particulate magnetic recording media utilizing metallic magnetic particles have exhibited disappointingly poor resolution, erasability and saturability.

We thus find, in the prior art, the anomalous disagreement between theory and practice, which has led away from the utilization of metallic magnetic particles in particulate media.

As was indicated above, many techniques of making metallic magnetic particles, including the preparation of cobalt-phosphorus particles by chemical reduction, are known in the art. Additionally, many prior art techniques for making magnetic particles have utilized some form of magnetic field during the actual preparation of the particles. However, heretofore, the prior art has not provided a suitable figure of merit for characterization of cobalt-phosphorus or other metallic magnetic particles for use in recording media and then utilized that figure of merit to recognize the improvements which could be obtained in metallic magnetic cobalt-phosphorus particles produced by chemical reduction by the application of a D.C. magnetic field of the proper magnitude during particle preparation. Without the recognition of the problem, the preparation of metallic magnetic particles by chemical reduction would remain a matter of chance, subject to inexplicable and non-reproducible successes and failures.

SUMMARY OF THE INVENTION

It is an object of the present invention to provide metallic magnetic cobalt-phosphorus particles produced by chemical reduction having improved characteristics for use in magnetic recording media.

It is another object of the present invention to provide such metallic magnetic cobalt-phosphorus particles having a $W/H_c$, as defined herein, of about 1.2 or less.

Other objects will appear hereinafter.

These and other objects are accomplished in accordance with the broad aspects of the present invention by preparing a bath including a soluble cobalt salt and then chemically reducing the cobalt cations to cobalt metal in a D.C. magnetic field of at least about 200 gauss using hypophosphite anions as a reducing agent. In the practice of this invention, other bath parameters and additives may be selected and controlled in accordance with any of the techniques known in the art. The operating ranges for the D.C. magnetic field are broad and require no control other than that they produce the desired improvement in $W/H_c$. The reaction time during which the magnetic particles are produced is not necessarily critical in so far as obtaining the desired range of $W/H_c$ is concerned. However, reaction sequence, timing, and time can affect other physical and magnetic characteristics. Reaction time can be controlled, for example, by quenching the reaction with large volumes of water. The presence or absence of other constituents in the reaction mixture can also be varied. The figure of merit $W/H_c$ of the resulting cobalt-phosphorus particles is considered to be indicative of the success or failure of treatment.

As shown hereinafter, a $W/H_c$ of about 1.2 characterizes relatively magnetically uniform particles which can be used in media to produce improved recording characteristics. Lower $W/H_c$'s achieve an even better result. Small uniform cobalt-phosphorus alloy particles having improved recording characteristics in magnetic recording media are formed by these techniques.

In certain embodiments, selected amounts of cobalt cations, hypophosphite anions, and other bath constituents and parameters have been determined are are utilized to achieve a desired coercivity range with a low $W/H_c$. Where the reactants and reactions are thus controlled, the reaction can be utilized to produce metallic magnetic particles having both selected reproducible coercivity characteristics and a low $W/H_c$. For example, in some forms of magnetic media, average coercivity in the range of about 500 to 550 oersteds is desirable for use with digital recording systems which are currently available on the market. However, it is anticipated that metallic magnetic particles having average coercivities in the range of about 850 to 950 oersteds will be desirable for systems having higher recording densities, and such particles can also be produced. Low $W/H_c$ particles having these coercivity ranges are the subject of the above-noted related U.S. patent application, Ser. No. 449,862, filed Mar. 11, 1974.

It is generally noted that cobalt-phosphorus particles produced in a D.C. magnetic field in accordance with the present invention, when viewed under high magnification, vary in shape. Some particles appear to be chains of spheres which are decidedly more acicular than untreated cobalt-phosphorus particles, while others appear as individual non-acicular spheres. Furthermore, the particles produced in accordance with this invention have not been found to be modified chemically from particles which are not produced in a D.C. magnetic field. Finally, it has been determined experimentally that A.C. magnetic fields and magnetic fields less than about 200 gauss do not normally provide cobalt-phosphorus particles having $W/H_c$'s of less than 1.2. Production of cobalt-phosphorus particles without magnetic fields or with magnetic fields other than D.C. fields of at least about 200 gauss, provide particles which when utilized in media provide low signal output, poor resolution, and problems of erasability and saturability.

The foregoing and other objects, features and advantages of this invention will be apparent from the following more particular description of preferred embodiments of the invention, and from the accompanying figures.

THEORY AND DEFINITION OF THE PROBLEM

Theoretically, particulate magnetic recording media provides the best signal output and resolution when the particles used in making the media are magnetically uniform. In a given sample of magnetic particles used to make a media, what is considered to be the coercive force of the sample is a weighted average of the actual coercive forces of each of the particles in the sample. The range of coercivities in a sample can vary over a broad range. Where media is made from particles having a broad range of coercivities, and it is used with magnetic recording systems now generally available, a problem may exist. The writing transducer is usually capable of generating a magnetic field having some relatively limited upper range. Such a system is therefore capable of writing or switching only those particles in the media having coercivities within the range of applied fields generated by the transducer.

More specifically, when a particulate magnetic recording media is prepared utilizing particles covering a very broad range of coercive forces, the resulting media is usually found to display disappointingly low signal output, poor resolution, and is both difficult to erase and to saturate. This is due to the fact that for a given recording media utilized with a recording system in a configuration designed to efficiently write and read the average coercivity of the media, there may be some substantial number or particles having coercivities so high that they are not switched by the effective magnetic field of the writing transducer. As these unswitched particles contribute no signal upon being read, the media provides a disappointingly low signal output. Furthermore, since the high coercivity particles are not switched, the effective average coercivity of the particles switched is less than the actual average coercivity of the media as measured by a magnetometer, and thus the resolution is less than would be predicted from that actual average coercivity. In a similar manner, the very high coercivity particles are difficult to switch, but once they are switched, they are difficult to switch again or to erase. Therefore, for a given transducing system having a write transducer of limited capacity, the narrower or more uniform the distribution of coercivities of the particles in the media, the more efficiently the media can be written or erased, and the larger its signal output will be on playback.

Now, having recognized the problem of magnetic uniformity, if the quality of a particulate media is to be determined, some means of characterizing the breadth or uniformity of coercivity of the particles incorporated in a media must be found. A figure of merit, as explained hereinafter, has been defined in this application. The figure of merit was arrived at by manipulating the information usually found for magnetic materials using hysteresis loop characterization.

Figure 1:
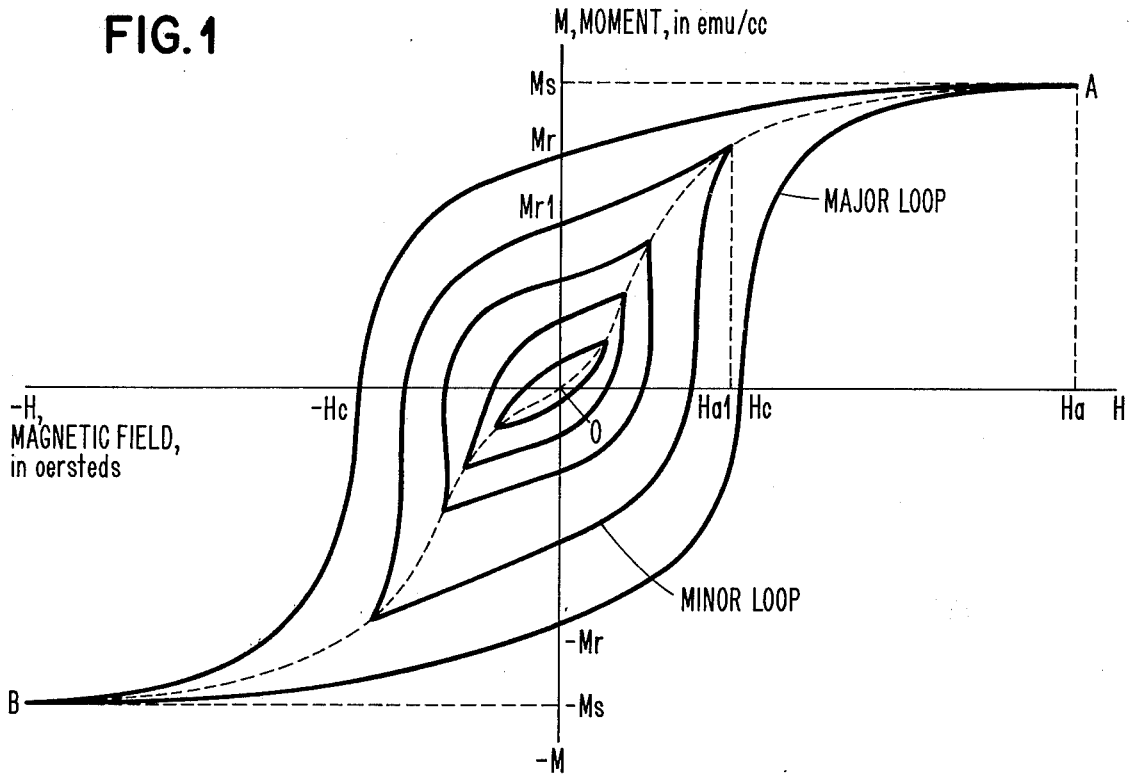
FIG. 1 is a diagrammatic representation of a major hysteresis loop and a number of representative minor hysteresis loops of a typical single-domain magnetic sample.

Referring now to the figures, FIG. 1 is a diagrammatic representation of hysteresis loops as they might be measured from a typical magnetic material. FIG. 1 includes both a saturated or "major" loop, as well as a number of included representative unsaturated or "minor" loops. Traces such as those shown in FIG. 1 are capable of being plotted automatically by a magnetometer or a B-H loop tracer under programmed computer control.

Now, to understand the following theory, one must first understand how magnetic materials behave when subjected to magnetic fields of various magnitudes and polarities. Referring to FIG. 1, when a magnetic field H is applied to a magnetic material, the material undergoes a change in magnetic moment M. For example, starting with A.C. demagnetized magnetic material, where both M and H equal zero (M=H=O), as an increasing magnetic field H is applied to the magnetic material, the moment M of the material increases along the dotted magnetization curve OA. Eventually, if a strong enough field is applied, the magnetic material reaches a maximum level of moment, designated as "saturation magnetization $M_s$". The maximum applied magnetic field required to reach saturation magnetization is designated herein as "$H_a$". Now it is a characteristic of fully saturated magnetic material that if the applied magnetic field is completely removed from the material (H=O), the moment of the magnetic material does not return to zero ($M \neq O$), but rather the moment relaxes along a portion of the hysteresis curve $AM_r$, to its remanent moment "$M_r$". $M_r$ is the level of moment or magnetization which the material will retain unless acted upon by other magnetic forces. Now, in order to further trace the major hysteresis loop, the material is switched or reversed by applying an increasing magnetic field of polarity opposite to $H_a$ until the moment eventually falls to zero at its negative coercivity "$-H_c$" along curve $-H_cM_r$. Curve $-H_cM_r$ is referred to as the demagnetizing portion of the hysteresis curve. If the magnetic field is then continuously increased in the same reversed polarity beyond $-H_c$, the material will eventually reach negative saturation magnetization "$-M_s$" at point B, with curve $-H_cB$ tracing another portion of the major hysteresis loop. Complete removal of the reversed polarity field (H=O) will now cause the magnetic field to relax along hysteresis curve $-M_rB$ to its negative remanent moment $-M_r$. Then, if a continuously increasing magnetic field of the same polarity as original $H_a$ is applied to the material, magnetization proceeds along the curve $-M_rH_cA$ to eventually complete the hysteresis loop. Since the material has reached magnetic saturation in both polarities, the hysteresis loop described is designated as a "major" loop. In the prior art the magnetic character of this major saturation loop is often considered completely indicative of the characteristics of the magnetic material.

Now, the present invention theorizes that for a given sample of magnetic particles the major loop is only indicative of a fully magnetized and saturated magnetic material. It is assumed herein that the major loop does not necessarily describe the magnetic character and distribution of the lower coercivity particles. Therefore, as a first step to understanding the magnetic character and distribution of the lower coercivity particles in a sample, a series of unsaturated or "minor" hysteresis loops are run and measured to characterize the particles.

Referring to FIG. 1 again, each of the representative hysteresis loops within the major loop is a minor loop, although only one is so labeled. Each minor loop has been formed by applying and reversing some magnetic field less intense than $H_a$ to A.C. demagnetized magnetic material. In each of these cases, when a nonsaturating magnetic field, $H_{al}$ for example, is applied and then removed from the partially saturated sample, the moment of the magnetic material relaxes to its own characteristic minor remanent moment, for example $M_{rl}$. Each minor remanent moment is less than $M_r$.

For purposes of this theory, it has been assumed that magnetic cobalt-phosphorus particles produced by chemical reduction are single-domain particles. This is a reasonable assumption, as particles having a size range of about 100 to about 1000 angstroms are normally found to be single-domain, and the cobalt-phosphorus samples produced by chemical reduction have generally been found to be in that size range. Based on these facts and assumptions, it has been further assumed that for single-domain particles, the component of remanent moment, for example $M_{rl}$, for each minor loop is a function of the vector sum of the magnetic moments of each single-domain particle which has been magnetized by the amount of magnetic field applied, for example $H_{al}$, used in producing the minor loop. It is therefore postulated that by comparing the relationship between remanent moment and applied magnetic field for each of the minor loops, an indication as to the relative number of particles switched by each level of applied field can be determined. Stated somewhat differently, for each applied field less than $H_a$, the resulting remanent moment is a function of the number of single-domain particles switched by that applied field. A mathematical representation of this relationship is provided later in this discussion.

Figure 2:
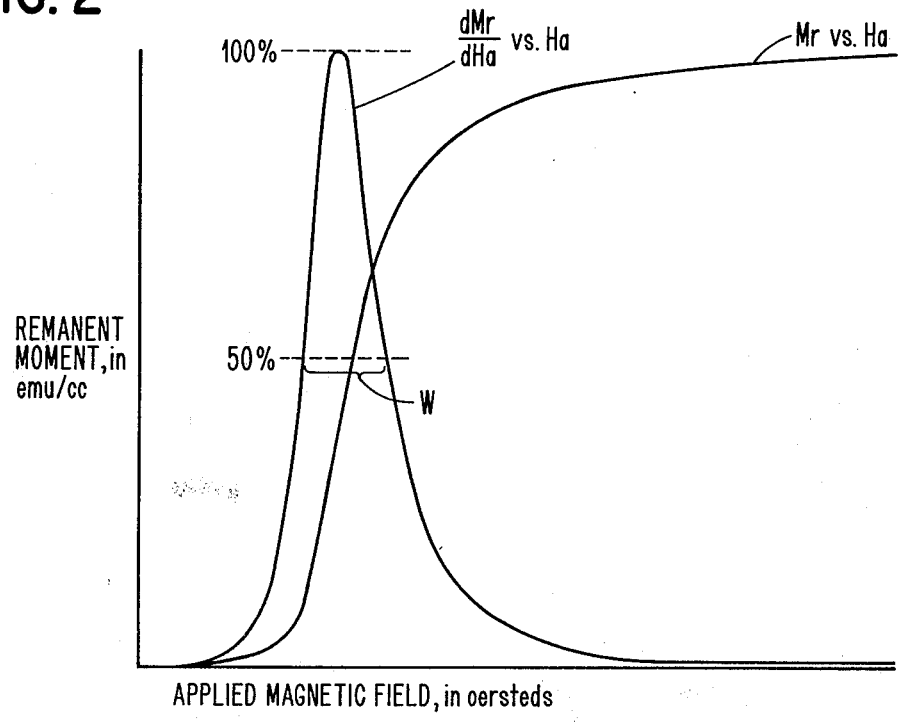
FIG. 2 is a pair of diagrammatic curves representing, first, a graph of $M_r$ versus $H_a$ as derived from the major and minor hysteresis loops of a sample of magnetic material and, second, a curve representing the first derivative of the $M_r$ curve with respect to $H_a$.

Now, referring to FIG. 2, there is depicted a representative curve of remanent moments versus the applied magnetic fields required to generate those remanent moments as would be determined from a large number of minor loops. For a given sample of magnetic particles, each minor loop defines a single point on the curve. Theoretically, an infinite number of minor loops could be generated to define this curve; however, in practice, only about 75 to 100 minor loops are used to define it.

Analysis of the remanent moment versus applied field curve by itself indicates that the major changes in remanent moment are experienced within a limited range of applied magnetic field. Therefore, extending the previous discussion, it may be presumed that the range of coercivities corresponding to the major changes in remanent moment are indicative of the distribution or coercivities in the sample. Indeed, such a measurement provides a fairly good first approximation of magnetic uniformity; however, it requires that some subjective judgment be applied to determine what portion of the curve is relevant. Thus, such a test will inherently vary from observer to observer.

Subjectivity can be eliminated if the derivative curve of $M_r$ versus $H_a$ is plotted. Such a derivative curve provides a precise and reproducible indication of magnetic uniformity. Additionally, if our previous presumptions have been correct, the derivative curve, $dM_r/dH_a$ versus $H_a$, can be presumed to proportionately represent the number of particles having a specific coercivity. This last presumption is derived from the earlier postulated relationship, wherein remanent moment indicates the relative number of particles switched by each level of applied field. The approximate mathematical relationship, showing $M_r$ as a function of an applied field, $H_a$ is:

$$M_r(H_a) = \int_0^{H_a} N(H)M_r(H)dH;$$

wherein:

$M_r(H_a)$ is the remanent moment due to a maximum applied field $H_a$. $M_r(H_a)$ corresponds to the remanent moment of all particles of coercivity less than or equal to $H_a$.

N(H), is the number of singledomain particles having a coercivity of some value H; and $M_r(H)$, is the remanent moment of all of the particles with coercivity of H.

It then follows that its derivative:

$$dM_r/dH \Big|_{H = H_a} = N(H_a)M_r(H_a),$$

when plotted against applied magnetic field represents a curve which at any point along the curve is proportional to the number of particles having the coercivity of that point. Thus the derivative curve, $dM_r/dH_a$ versus $H_a$, serves to conveniently show the uniformity or breadth of coercivity of the particles in a sample and the proportional number of particles at each level of coercivity.

Stated somewhat differently, the curve, $dM_r/dH_a$ versus $H_a$, effectively represents the switching field distribution of the sample. Unfortunately, such a derivative switching field distribution curve does not by itself represent a number or figure of merit which can be conveniently used to characterize the uniformity of the sample. A more convenient way to further characterize or define the uniformity of the sample as determined from the derivative curve is defined below.

In the present invention it has been decided to measure the full width or range of coercivity at half (50%) the maximum height of the derivative curve. This full width at half the maximum height has been designated as "W". W, in oersteds, is by itself a meaningful representation of the uniformity of coercivity in the sample. Unfortunately, however, W by itself does not take into account the variations in W which are to be expected as the average coercivity $H_c$ of the sample varies. It has thus been determined to normalize W for the variation in coercivity for each sample by dividing W by $H_c$. Therefore, as used herein, the figure of merit is:

$$W/H_c = \frac{\text{full width of the derivative curve at half its maximum height}}{\text{average coercivity.}}$$

$W/H_c$ thus represents a figure of merit which can be determined with mathematical precision and which is normalized to take into account the average coercivity of each sample.

The desirability of having a $W/H_c$ less than about 1.2 for cobalt-phosphorus produced by chemical reduction has been derived primarily by experience. Theoretically, the $W/H_c$ by definition is intended to be representative of the magnetic uniformity or switching field distribution of the sample, and as such should be as small as possible. By measuring W for many cobalt-phosphorus samples produced by chemical reduction before the present invention, it was determined that prior art $W/H_c$'s generally fell in the range of about 1.4 to 4. It was also determined that when cobalt-phosphorus samples having $W/H_c$'s of about 2 to 4 were used in a recording media, the media exhibited poor recording characteristics. For example, they exhibited low 6 dB densities. One of the best prior art cobalt-phosphorus media available was characterized by:

$W = 470$ oe., $H_c = 340$ oe., and $W/H_c = 1.4$.

This sample, having a $W/H_c$ of 1.4 was compared with media having greater coercivities, but also having $W/H_c$'s greater than 1.4. It was found that the media with $W/H_c$ of 1.4 had a greater 6 dB density than the media having higher $W/H_c$'s, despite the fact that they also had a higher average coercivities. However, even the sample having $W/H_c$ of 1.4 was not fully satisfactory as a high density recording media. Additionally, samples of cobalt-phosphorus having $W/H_c$'s as low as 1.4 could not be produced consistently.

As has already been noted, characterizations of $W/H_c$ were made for many samples of cobalt-phosphorus which were produced by chemical reduction before the present invention. Generally, the best $W/H_c$'s found were about 1.4 and no sample of cobalt-phosphorus having $W/H_c$'s of 1.4 or higher was found which produced a media with fully satisfactory high density recording characteristics. It was thus suggested that a $W/H_c$ of at least less than 1.4 is required for cobalt-phosphorus having the good magnetic uniformity which is required for good high density magnetic recording media.

Many techniques were pursued to produce cobalt-phosphorus having a $W/H_c$ less than 1.4. These techniques included varying bath parameters, adding additional non-magnetic metal salts to the reaction mixture, grinding the particles after they were produced, and other techniques. Some of the non-magnetic salt additive and grinding techniques were found to produce particles having $W/H_c$'s lower than about 1.2, but these techniques by themselves had the shortcomings of affecting other magnetic or physical properties of the particles in an unsatisfactory manner. In the midst of this experimentation, it was noted that random samples of cobalt-phosphorus appeared to have unexplainably lower $W/H_c$'s than other samples made in the same manner. Generally, even these "good" samples had $W/H_c$'s greater than 1.2. In order to determine what caused the improvements in these samples, painstaking reconstruction of the procedures used in producing the anomalously good samples was made. It eventually became apparent that the common link between these good samples was the use of a magnetic stirring apparatus during the preparation of the particles. Now, with this insight, a full series of experiments where scheduled to determine the effects that magnetic fields had upon the $W/H_c$'s of cobalt-phosphorus prepared by chemical reduction. This eventually lead to the discovery that when a D.C. magnetic field of at least about 200 gauss is applied to the reaction mixture during the production of cobalt-phosphorus particles by chemical reduction, the particles consistently having $W/H_c$'s of about 1.2 or less.

Additional experimentation confirmed the fact that cobalt-phosphorus samples made in a strong D.C. field from a controlled bath and under controlled conditions consistently produced cobalt-phosphorus particles having $W/H_c$'s less than 1.2, and that such particles were useful in preparing superior high density recording media. It was also determined that D.C. magnetic fields of lower magnitude, A.C. magnetic fields, or combined A.C./D.C. fields, were not operative to consistently produce particles having $W/H_c$'s of less than about 1.2.

Thus, a useful figure of merit, $W/H_c$ less than about 1.2, has been defined. The available data also indicates that cobalt-phosphorus produced by chemical reduction having a $W/H_c$ of less than about 1.2, is substantially non-existent without the application of a strong D.C. magnetic field during particle preparation.

Based upon the above information and theory, it is possible to derive other figures of merit from the switching field distribution derivative curve of FIG. 2. However, it is believed that no other figure of merit would be simpler to derive, nor give any information characterizing the magnetic uniformity of the particles, which information would be either contrary or superior to the information derived from the figure of merit, $W/H_c$. Of course, there may be instances when $W/H_c$ gives misleading information. For example, a sample having abnormal distribution or breadth below the half weight (50% level) of the derivative curve may be encountered. Then the broad teachings of this theory could be used to select an alternative figure of merit, say one based on 5%, 10% or 25% of the derivative curve height. Of course, if such an alternative figure of merit were selected, it would be necessary to determine at what values of that figure of merit a magnetic sample provides media having good recording characteristics. In a similar manner, more than one figure of merit could be used to characterize a single sample.

It is therefore seen that in the pursuit of the present invention, several distinct steps were required. First, it was necessary to recognize the fact that prior art cobalt-phosphorus produced by chemical reduction suffered from extremely non-uniform switching field distribution. Second, it was necessary to utilize available information and theory to define a figure of merit, in this case $W/H_c$, with which the magnetic uniformity of the cobalt-phosphorus could be characterized. Once a figure of merit was defined, it became necessary to determine what a good number for the figure of merit was. Then a method to produce cobalt-phosphorus having a good figure of merit number had to be developed. Finally, after it was recognized that a magnetic field could be utilized to provide cobalt-phosphorus having good figure of merit, it was necessry to quantify and qualify the magnitude and type of magnetic field which is required to consistently produce cobalt-phosphorus with a good figure of merit. Without the recognition of the problem, its characterization in terms of a figure of merit, and the experimental determination of those parameters which produce a good figure of merit, the present invention, taken as a whole, could not have been made.

DESCRIPTION OF THE PREFERRED EMBODIMENTS

In the preparation of the cobalt-phosphorus particles of the present invention, the D.C. magnetic field is present during the reaction to form the metal particles. After particle formation, the cobalt-phosphorus is separated from the reaction mixture, washed with water and/or organic solvents, and then dried, preferably under non-oxidizing conditions. To enhance their dispersion characteristics, the dried particles may be reacted with a solution containing sulfuric acid, in accordance with the teaching of copending U.S. application serial No. 393,258, now U.S. Pat. No. 3,905,841, assigned to the assignee of the present application. In other instances, dispersion characteristics may be improved by making ultrafine particles with large surface area, as described in the following Example V.

Regardless of which technique is utilized, the powder samples prepared in accordance with the present invention are measured, for example with a 60 cycle vibrating sample magnetometer, VSM, to determine their minor and major loop characteristics and other magnetic properties. When desired, determination of the chemical content of the alloy particles is obtained by wet chemical analysis. Particle sizes and shapes are determined from electron micrographs.

In the preparation of the improved cobalt-phosphorus particles of the present invention, the cobalt cations are provided by the use of any suitable soluble cobalt salt, such as cobalt chloride, cobalt sulfate, cobalt acetate, cobalt sulfamate and others. The hypophosphite anion is normally brought into solution in the form of an alkaline metal hypophosphite. In the most common preparations of cobalt-phosphorus particles, complexing agents, such as citrates and malonates, are brought into solution in the form of the acid or as an alkaline metal salt in varying ion concentrations. However, such complexing agents are not essential to the practice of the present invention. Hydroxide ions are required in the solution to maintain a basic reaction system, with ammonium hydroxide preferred. Catalysts, such as finely divided palladium metal or soluble palladium salts, are commonly utilized as nucleating sites to initiate the reaction. The 0.1% palladium chloride-hydrochloric acid referred to in the following examples are formed using 1 gram of palladium chloride and 10 cubic centimeters of 37% hydrochloric acid in a solution having a total volume of 1 liter. Other catalysts and concentrations of catalysts can of course be utilized. When catalysts are utilized, small quantities of the catalytic material can be found in the precipitated particles along with the cobalt and phosphorus constituents.

Where 0.1% palladium chloride-hydrochloric acid is used as the catalyst, the resulting magnetic alloy particles produced in the practice of the present invention have been found to have $W/H_c$ of less than about 1.2 and to consist of about 91 to 94.6% cobalt, about 2.1 to 4.9% phosphorus and about 0.15 to 0.82% palladium, all by weight. The balance is believed to consist of oxygen, present primarily at the surface of the particles.

While the teaching of the present invention is directed primarily to the preparation of cobalt-phosphorus alloys, it is equally applicable to, and intended to include, magnetic cobalt particles produced by chemical reduction which also includes other magnetic metal constituents.

The following examples are given merely to aid in the understanding of the invention, and variations may be made by one skilled in the art without departing from the spirit of the present invention.

EXAMPLE I

A cylindrical beaker containing an aqueous 3,520 milliliter solution including 140 grams cobalt sulfate ($CoSO_4.7H_2O$), 280 grams sodium citrate ($Na_3C_6H_5O_7.2H_2O$), and 160 grams sodium hypophosphite ($NaH_2PO_2.H_2O$) was prepared, placed in a solenoidal magnetic field of 1,000 ± 100 gauss intensity, and heated to boiling. The solution was subjected to mechanical stirring during its preparation and heating. To the hot solution was added 80 milliliters of 0.1% palladium chloride ($PdCl_2$)-hydrochloric acid (HCl) solution followed in about 10 seconds by 400 milliliters of 28% ammonium hydroxide ($NH_4OH$). Stirring was stopped and within several seconds a vigorous reaction occurred in which the reaction mixture darkened and gas evolved from the mixture. Finely divided dark gray particles were formed and precipitated within the beaker.

After about 6 minutes, the reaction was quenched with about 4000 milliliters of cold water. The magnetic field of the solenoid was then turned off, the dark precipitate allowed to settle, and the reaction mixture decanted. The particles were then washed 3 times with water, 3 times with acetone, and dried as completely as possible under non-oxidizing conditions. The particle yield was about 86%, based on the amount of available cobalt.

An unweighted portion of the resulting particles was dispersed in an organic binder, coated on a narrow substrate, the substrate placed within a 1000 oersted orienting magnetic field of a solenoid, and the binder dried. The resulting film was then used for determination of the W/H$_c$ of the particles by the VSM. A series of minor hysteresis loops and the major hysteresis loop of the coating were run. Other magnetic properties were determined by packing a measured amount of dry particles in a glass cylinder for measurement by the VSM. The particles were found to exhibit an average coercive force of 510 oersteds and a squareness ratio of 0.82. The full width at half maximum W was found to be 260 oersteds, and the W/H$_c$ 0.51. Electron micrographs of the powder indicated that it consisted of particles having an average length of about 0.3 micron with a length to width ratio of about 3 to 1. Its chemical composition was about 92.2% cobalt, 2.4% phosphorus, 0.6% palladium, with the balance believed to be oxygen, the oxygen being present mainly at the surface of the particles.

Using the technique of Example I, samples having average coercivities in the range of about 500 to about 550 oersteds and W/H$_c$'s of less than 1.2 can be consistently prepared. Materials in this coercivity range having good magnetic uniformity are formed into recording media which are easily written and read by contemporary recording equipment. However, such media produces three times the signal output of the best iron oxide media now available over a frequency range of 0 to 10,000 flux changes per inch.

Surprisingly, any significant variation from the procedure of Example I results in a substantial change in the average coercivity and in the W/H$_c$ of the cobalt-phosphorus produced.

EXAMPLE II

An aqueous 2100 milliliter solution containing 105 grams cobalt sulfate, 105 grams sodium citrate, and 600 grams sodium hypophosphite was prepared and heated to boiling within a solenoidal magnetic field of 1000 ± 100 gauss intensity while being vigorously stirred utilizing a mechanical mixer. To this hot solution was added 600 milliliters of a solution containing 3 grams sodium hypophosphite, 180 grams of Rohm and Haas Co. Acrysol A-5 aqueous polymer solution (25% A-5 polyacrylic acid by weight), and 30 milliliters of 0.1% palladium chloride-hydrochloric acid solution. This was then followed after about 10 seconds by the addition of 300 milliliters of 28% ammonium hydroxide aqueous solution. A vigorous reaction occured and was allowed to proceed for about 8 minutes with continuous stirring, followed by quenching with an equal volume of cold water. The black precipitate formed by the reaction was then washed 3 times with water and 3 times with acetone, and dried under non-oxidizing conditions. The yield of the reaction was about 50%, based on available cobalt.

As in Example I, portions of the sample were prepared and measured by the VSM for their magnetic properties and W/H$_c$. The particles were found to exhibit an average coercive force of 900 oersteds, a squareness ratio of 0.76, a W of 250 oersteds, and an excellent low W/H$_c$ of 0.28.

Using the techniques of Example II, samples having intrinsic coercivities of about 850 to about 950 oersteds and W/H$_c$'s of less than about 0.35 can be consistently prepared. The procedure described in Example II must be strictly followed for W/H$_c$'s of less than 0.35 and high intrinsic coercivities of about 850 to about 950 oersteds to be realized. Coercivities in this range will be useful in future recording media when higher write currents are used to record greater densities of information.

EXAMPLES III AND IV

A large batch of cobalt-phosphorus was made in accordance with the present invention. In a large container in a solenoidal magnetic field of 1000 ± 100 gauss intensity an aqueous 20 gallon (90.9 liters) solution containing 2967 grams of cobalt sulfate, 5935 grams sodium citrate, and 3391 grams of sodium hypophosphite was prepared and heated to 91°C with vigorous mechanical stirring. To the solution was added 1.5 liters of 0.1% palladium chloride-hydrochloric acid solution followed by the addition of 2 gallons (9.1 liters) of 28% ammonium hydroxide. Stirring was stopped, and the reaction was allowed to proceed for about 6 minutes. The reaction was then quenched with about 15 gallons (68.2 liters) of cold water. The solenoidal magnet was turned off, the dark precipitate allowed to settle and the reaction mixture decanted. The particles were washed with water and dried under non-oxidizing conditions. The yield of cobalt-phosphorus was about 81.5%, based on available cobalt.

A portion of the resulting particles was measured for magnetic properties, as in Example I. The particles were found to exhibit an overall average intrinsic coercive force of 506 oersteds, and a squareness ratio of 0.78. The W was found to be 224 oersteds, and the W/H$_c$ was 0.44.

To test its reproducibility, the foregoing particle preparation was repeated using the same amount of constituents, the same reaction temperature, and the same reaction time. This second reaction resulted in magnetic cobalt-phosphorus particles having a coercivity of 508 oersteds, a squareness ratio of 0.79, a W of 214, a $W/H_c$ of 0.42. It is therefore seen that there was a high degree of reproducibility between these examples, including reproducibility of the important figure of merit, $W/H_c$, less than about 1.2.

EXAMPLE V

The following technique provided magnetic cobalt-phosphorus particles which exhibited both good magnetic uniformity, as measured by a low $W/H_c$ and good dispersability in a binder system. It is further noteworthy as the reaction was carried out in an unheated solution at ambient temperatures and without the use of sodium citrate or other complexing agents. A 3300 cubic centimeter solution containing 160 grams cobalt sulfate and 240 grams sodium hypophosphite was prepared in a container residing in a solenoidal magnetic field of 1000 ± 100 gauss intensity with mechanical stirring. To the solution was added 350 milliliters of 0.1% palladium chloride-hydrochloric acid solution and 350 milliliters of 28% ammonium hydroxide. An initial blue color was noted in the reaction mixture, followed by a vigorous reaction. The reaction was allowed to proceed for 6 minutes at ambient temperatures, the reaction quenched with 4 liters of cold water, and the solenoid turned off. The magnetic powder was removed, washed, and tested, as in Example I.

The resulting particles were found to exhibit an average coercive force of 911 oersteds, a squareness ratio of 0.64, a W of 925, and a $W/H_c$ of 1.02.

Additionally, the particles were extremely small, about 150 to about 300 angstroms in diameter, with high surface areas and good dispersion characteristics when mixed with a polymer binder to form a magnetic recording media.

EXAMPLES VI AND VII

Two identical reaction mixtures were prepared and reacted under the same conditions, with the exception of the D.C. magnetic field. Example VI was prepared utilizing a D.C. magnetic field. Example VII was prepared without the use of a magnetic field. The reaction mixture had the following constituent makeup:

| | |
|---|---|
| Cobalt SUlfate | 140 grams |
| Sodium Citrate | 280 grams |
| Sodium Hypophosphite | 160 grams |
| 28% Ammonium Hydroxide | 400 milliliters |
| 0.1% $PdCl_2$-HCl | 1200 milliliters |
| Water | 3520 milliliters |
| Reaction Temperature | 85°C |
| Reaction Time | 6 minutes |

The magnetic properties of the particles produced are summarized in Table I.

Table I

| Example | D.C. Field | Squareness Ratio | Coercivity, in oe. | W. in oe. | $W/H_c$ |
|---|---|---|---|---|---|
| VI | Field | 0.72 | 785 | 486 | 0.62 |
| VII | No Field | 0.40 | 781 | 1022 | 1.31 |

These two examples readily illustrate the effect that the presence of a D.C. magnetic field has upon magnetic uniformity as measured using $W/H_c$.

EXAMPLES VIII — XIX

Twelve additional samples were prepared from a common type of bath following the general procedure of Example I. The bath was as follows:

| | |
|---|---|
| Cobalt Sulfate | 7.5 grams |
| Sodium Citrate | 22.5 grams |
| Sodium Hypophosphite | 40 grams |
| 0.1% $PdCl_2$-HCl | 25 milliliters |
| 28% Ammonium Hydroxide | 200 milliliters |
| Water | 950 milliliters |
| Temperature | Heated |
| Reaction Time | 2 minutes |

In Examples VIII—XIII a D.C. magnetic field was applied to the reaction mixture by placing a pair of 2000 gauss horseshoe-shaped permanent magnets outside of, and next to, a 1 gallon reaction vessel. The two magnets were diametrically opposed and with their unlike poles opposed to one another. In Examples XIV–XIX no D.C. magnetic field was applied to the reaction mixture.

The results of these procedures is summarized in Table II.

Table II

| Example | D.C. Field | Squareness Ratio | Coercivity in oe. | W in oe. | $W/H_c$ |
|---|---|---|---|---|---|
| VIII | Field | 0.41 | 525 | 425 | 0.81 |
| IX | Field | 0.37 | 527 | 550 | 1.04 |
| X | Field | 0.38 | 475 | 440 | 0.93 |
| XI | Field | 0.38 | 547 | 395 | 0.72 |
| XII | Field | 0.35 | 568 | 600 | 1.06 |
| XIII | Field | 0.41 | 617 | 560 | 0.91 |
| XIV | No Field | 0.28 | 595 | 1200 | 2.01 |
| XV | No Field | 0.33 | 642 | 1150 | 1.79 |
| XVI | No Field | 0.36 | 780 | 1300 | 1.67 |
| XVII | No Field | 0.24 | 466 | 920 | 1.97 |
| XVIII | No Field | 0.31 | 634 | 940 | 1.48 |
| XIX | No Field | 0.32 | 672 | 1000 | 1.49 |

It is thus apparent from Examples XIII–XIX that for a large number of reactions in which the only significant parameter change is the presence or absence of a D.C. magnetic field, the presence of a D.C. magnetic field results in a striking improvement in the magnetic uniformity, as represented by $W/H_c$, of cobalt-phosphorus particles produced by chemical reduction. It is further apparent from a review of this data that squareness ratio, which is often considered an important measure of magnetic character, is not as sensitive a gauge of magnetic uniformity as $W/H_c$.

It is also worth noting that utilizing a permanent magnet arrangement to provide the D.C. magnetic field, as in Examples VIII–XIII, results in a non-uniform field distribution within the reaction vessel. For example, mapping the reaction vessel with a Hall probe, it was found that the magnetic field in the vessel next to the pole tips was 2000 gauss, the magnetic field at the inner circumference of the vessel half way between the two magnets was 200 gauss, while the magnetic field at the center of the vessel was only 10 gauss. However, even with this stark non-uniformity of magnetic field, the presence of the D.C. magnetic field had a decisive effect on the uniformity of the particles as indicated by $W/H_c$. It is seen that for Examples VIII–XIII, prepared with a D.C. magnetic field, the average $W/H_c$ was 0.91. By comparison, Examples XIV–XIX, prepared in the same manner, but without a magnetic field, had an average $W/H_c$ of 1.73. All examples produced with a magnetic field had a $W/H_c$ of less than 1.2. All examples produced without a magnetic field had a $W/H_c$ of greater than 1.2.

The magnetic field required for the practice of the present invention can be supplied in several ways. In Examples VIII–XIII, a number of permanent magnets have been placed around a reaction vessel to provide a D.C. magnetic field of the required strength. However, as noted, the use of permanent magnets around a vessel of any substantial size can result in wide variations of magnetic field intensity within different areas of the vessel. A more practical means of supplying a magnetic field has proved to be the utilization of a solenoid completely surrounding the reaction vessel to generate a uniform magnetic field. The field within a vessel surrounded by a suitably prepared solenoid is relatively uniform to within about ± 10%. As used herein "solenoid" means a coil of electrically conductive material commonly in the form of a cylinder which, when carrying an electrical current, generates a magnetic field within the coil.

While the preferred D.C. magnetic field has been found to be about 1000 gauss, a range of fields between about 200 and about 2000 gauss has been found effective to provide particles with a $W/H_c$ of 1.2 or less. Indeed, any amount of D.C. magnetic field will cause some improvement in the $W/H_c$. Fields of greater than 2000 gauss may also be useful; however, the improvements achieved by using a field greater than about 1000 gauss have been nominal.

It would appear likely that A.C. magnetic fields could be utilized to obtain the same results as the D.C. magnetic field taught by the present invention. This is not the case. Only D.C. magnetic fields have been found to produce $W/H_c$'s substantially below 1.2. Where A.C. magnetic fields or no magnetic field have been used, the $W/H_c$'s have been, typically, about 1.4 to about 4. Similarly, the combination of both A.C. and D.C. fields have been found to be unsuitable to produce magnetic cobalt-phosphorus particles having a $W/H_c$ of less than 1.2.

Many more samples of cobalt-phosphorus have been produced than are reported herein. They all generally support the finding that a $W/H_c$ of less than about 1.2 is usually produced in a D.C. magnetic field of 200 gauss or more, and that $W/H_c$'s of less than 1.2 are virtually non-existent without a D.C. magnetic field. In testing the magnetic properties of the cobalt-phosphorus particles, a Scientific Atlanta 60 cycle loop tester was usually used. About 75 to 100 loops were normally measured for each sample, including a major loop. The varying fields applied to the sample were usually stepped and controlled by means of a closed loop process control computer program. A related program then reduced the data obtained from the hysteresis loops and used that data to automatically plot and measure the $M_r$ versus $H_a$ curve, and the derivative of that curve. In each instance, the particles have been dispersed in a binder and oriented in a magnetic field during drying, prior to obtaining minor loop data.

Uses for the materials produced in accordance with the teaching of this invention are well known. The low $W/H_c$ cobalt-phosphorus alloy particles produced by the foregoing examples may be dispersed with non-magnetic organic film-forming materials and their solvents to produce magnetic media. Typical, but not limiting, binders for preparing various recording media including ferromagnetic particles produced in accordance with this invention are phenoxies, epoxies, polyesters, cellulose esters and ethers, vinyl chloride vinyl acetate, acrylate and styrene polymers and copolymers, polyurethanes, polyamides, aromatic polycarbonates, polyphenyl ethers and various mixtures thereof. A wide variety of solvents may be used for forming a dispersion of the magnetic particles and binders. Organic solvents, such as ethyl, butyl, and amyl acetate, isopropyl alcohol, dioxane, acetone, methyl ethyl ketone, methylisobutyl ketone, ethylene glycol monomethyl ether acetate, cyclonexanone, tetrahydrofuran and toluene are useful for this purpose.

The particle-binder dispersion may be applied to a suitable substrate by roller coating, gravure coating, knife coating, extrusion, or spraying of the mixture onto the backing, or by other known methods. The specific choice of non-magnetic substrate, binder, solvent, or method of application of the magnetic composition to the support will vary with the properties desired and the specific form of the magnetic recording medium being produced.

In preparing recording media, the treated magnetic particles of the present invention usually comprise about 40% to 90%, by weight, of the solids in the film layer applied to the substrate. The substrate is usually a flexible resin, such as polyester or cellulose acetate material; although other flexible materials as well as rigid base materials are more suitable for some uses.

While the invention has been particularly shown and described with reference to the best mode and other preferred embodiments thereof, it will be understood by those skilled in the art that various changes in form and details may be made therein without departing from the spirit and scope of the invention.

What is claimed is:

1. A method for preparing finely divided magnetic cobalt-phosphorus alloy particles having a $W/H_c$ of less than about 1.2 and useful in preparing high density recording media by chemical reduction, comprising the steps of:

preparing an aqueous solution consisting essentially of hypophosphite anion reducing agent and at least one soluble salt of cobalt as a source of cobalt cations and reacting said cobalt cations with said hypophosphite anions to produce magnetic cobalt-phosphorus alloy particles;

wherein the improvement comprises carrying out the reduction reaction to produce the cobaltphosphorus alloy particles in the presence of a D.C. magnetic field of at least about 200 gauss to form cobalt-phosphorous alloy particles characterized by a $W/H_c$ of about 1.2 or less and useful in preparing high density recording media.

2. The method of claim 1 wherein the D.C. magnetic field is generated by at least one permanent magnet.

3. The method of claim 1 wherein the D.C. magnetic field is generated by a solenoid.

4. The method of claim 1 wherein the D.C. magnetic field is in the range of about 200 to about 2000 gauss.

5. The method of claim 2 wherein said D.C. magnetic field is about 1000 ± 10% gauss.

6. The method of claim 1 wherein sodium hypophosphate is the source of hypophosphite anions, cobalt sulfate is the source of cobalt cations and wherein the solution includes sodium citrate, palladium chloride and ammonium hydroxide.

7. Magnetic cobalt-phosphorus particles characterized by a $W/H_c$ of about 1.2 or less produced by the method of claim 1, consisting essentially of 91% to 94.6%, by weight, of cobalt, about 2.1% to about 4.9%, by weight, phosphorus, about 0.15% to about 0.82%, by weight, palladium, the balance being primarily oxygen.

8. A method of making a magnetic coating composition suitable for use in the manufacture of magnetic recording media consisting of the steps of:

bringing together particles produced in accordance with the process of claim 1 with an organic resin binder and solvent therefor; and then mixing said particles and resin to produce a mixture.

9. The method of claim 8 wherein the binder includes polyurethane.

10. The method of making a magnetic recording media consisting of the steps of:

coating the composition of claim 8 onto a non-magnetic substrate; and then drying the coating.

11. Magnetic recording media produced in accordance with the method of claim 10.

* * * * *